US012310497B2

(12) United States Patent
Chen et al.

(10) Patent No.: US 12,310,497 B2
(45) Date of Patent: May 27, 2025

(54) SLIDE RAIL ASSEMBLY

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shun-Ho Yang, Kaohsiung (TW); Kai-Wen Yu, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 167 days.

(21) Appl. No.: 18/084,749

(22) Filed: Dec. 20, 2022

(65) Prior Publication Data

US 2024/0041207 A1 Feb. 8, 2024

(30) Foreign Application Priority Data

Aug. 8, 2022 (TW) ..... 111129954

(51) Int. Cl.
*A47B 88/473* (2017.01)
*A47B 88/483* (2017.01)

(52) U.S. Cl.
CPC ..... *A47B 88/473* (2017.01); *A47B 88/483* (2017.01); *A47B 2210/0094* (2013.01)

(58) Field of Classification Search
CPC ..... A47B 88/473; A47B 88/483; A47B 2210/0094
USPC ..... 312/319.1
See application file for complete search history.

(56) References Cited

U.S. PATENT DOCUMENTS

| | | | | |
|---|---|---|---|---|
| 8,210,623 | B2 | 7/2012 | Chen et al. | |
| 10,398,228 | B2 | 9/2019 | Chen et al. | |
| 10,781,855 | B2 | 9/2020 | Chen et al. | |
| 11,375,811 | B2 | 7/2022 | Chen et al. | |
| 2013/0004102 | A1* | 1/2013 | Hsu | H04M 1/0237 384/26 |
| 2020/0214444 | A1* | 7/2020 | Chen | A47B 88/473 |

FOREIGN PATENT DOCUMENTS

| | | | |
|---|---|---|---|
| CN | 108505867 | A | 9/2018 |
| TW | 201225880 | A1 | 7/2012 |

* cited by examiner

*Primary Examiner* — James O Hansen
(74) *Attorney, Agent, or Firm* — Best & Flanagan LLP

(57) ABSTRACT

A slide rail assembly includes a first rail, a second rail, a plurality of working members and a damping module. The second rail and the first rail are movable relative to each other. The plurality of working members are arranged on the first rail. The damping module is arranged on the second rail. When the second rail is moved relative to the first rail from a predetermined position along a direction, one of the plurality of working members is configured to interact with the damping module in order to provide damping effect. When the second rail is further moved relative to the first rail along the direction, another one of the plurality of working members is configured to interact with the damping module in order to provide damping effect.

18 Claims, 18 Drawing Sheets

SLIDE RAIL ASSEMBLY

BACKGROUND OF THE INVENTION

1. Field of the Invention

The present invention relates to a slide rail assembly, and more particularly, to a slide rail assembly with a damping device.

2. Description of the Prior Art

U.S. Pat. No. 8,210,623B2 discloses a damping device used in a slide assembly. The slide assembly comprises a first rail, a second rail, a first support frame, a second support frame, a rack and a damper. The second rail is movable relative to the first rail. The first support frame is fixedly mounted to the first rail, and the second support frame is fixedly mounted to the second rail. The rack is mounted to the first support frame. The damper is mounted to the second support frame, and includes a box and a gear pivotally connected to the box. The box includes a damping material received therein. When the second rail is moved relative to the first rail, the gear of the damper is driven to rotate by the rack to interact with the damping material in the box, so as to provide a constant damping force.

However, for different market requirements, sometimes it is undesirable to use such gear configuration to generate a damping force when two rails are moved relative to each other. Therefore, it is important to develop various products to meet the market requirements.

SUMMARY OF THE INVENTION

The present invention provides a slide rail assembly with a damping device.

According to an embodiment of the present invention, a slide rail assembly comprises a first rail, a second rail, a first working member, a second working member and a damping module. The second rail is longitudinally movable relative to the first rail. The first working member and the second working member are arranged on the first rail. The first and second working members are arranged at different vertical positions along a height direction of the slide rail assembly. The damping module arranged on the second rail. When the second rail is moved relative to the first rail from a first predetermined position along a first direction, the first working member is configured to interact with the damping module in order to provide damping effect. When the second rail is further moved relative to the first rail along the first direction, the second working member is configured to interact with the damping module in order to provide damping effect.

According to another embodiment of the present invention, a slide rail assembly comprises a first rail, a second rail, a plurality of working members and a damping module. The second rail is longitudinally movable relative to the first rail. The plurality of working members are arranged on the first rail. The damping module is arranged on the second rail. When the second rail is moved relative to the first rail from a first predetermined position along a first direction, a first one of the plurality of working members is configured to interact with the damping module in order to provide damping effect. When the second rail is further moved relative to the first rail along the first direction, a second one of the plurality of working members is configured to interact with the damping module in order to provide damping effect.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
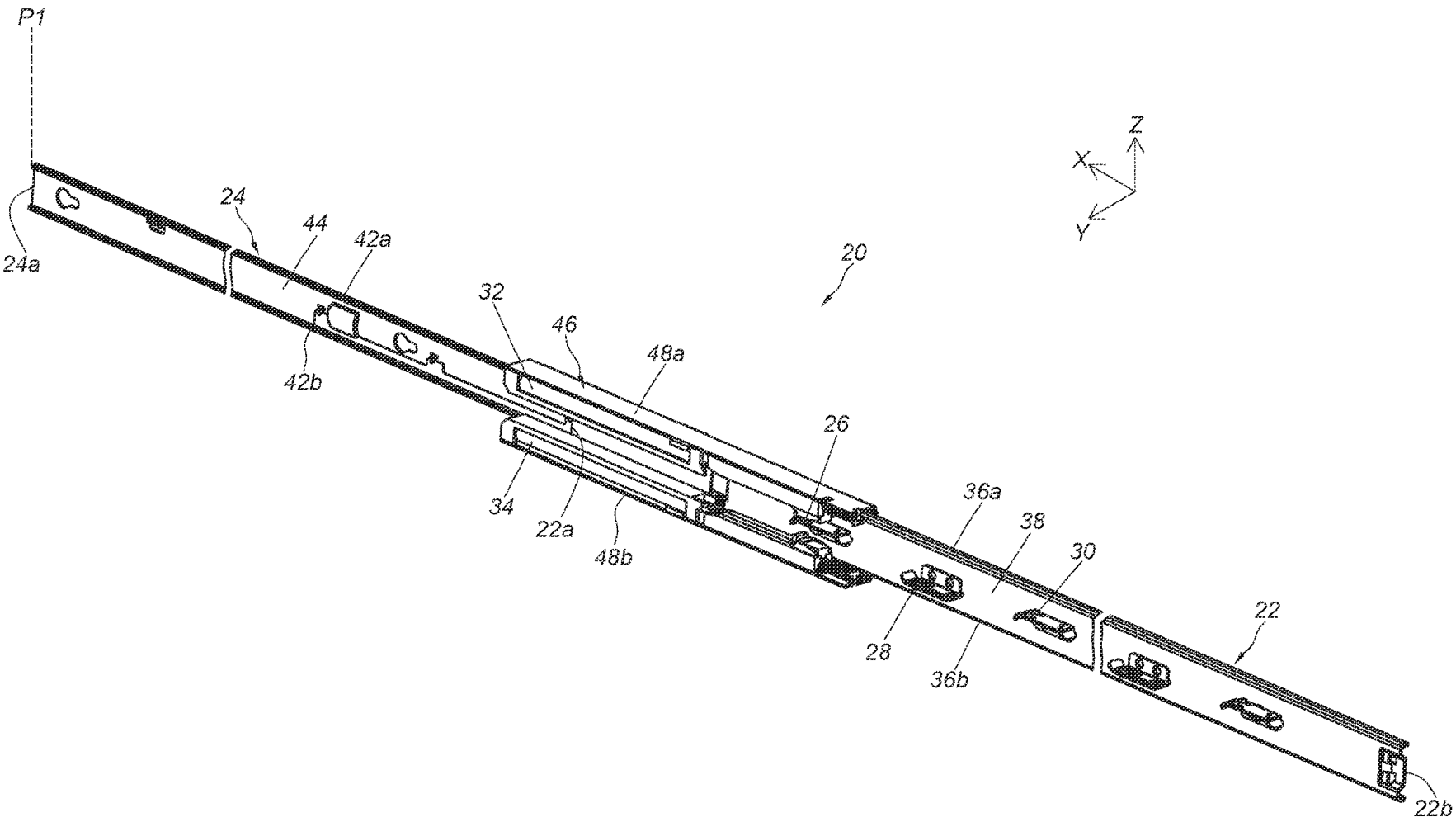
FIG. 1 is a diagram showing a slide rail assembly having a first rail and a second rail being located at a first predetermined position relative to the first rail according to an embodiment of the present invention.
Figure 2:
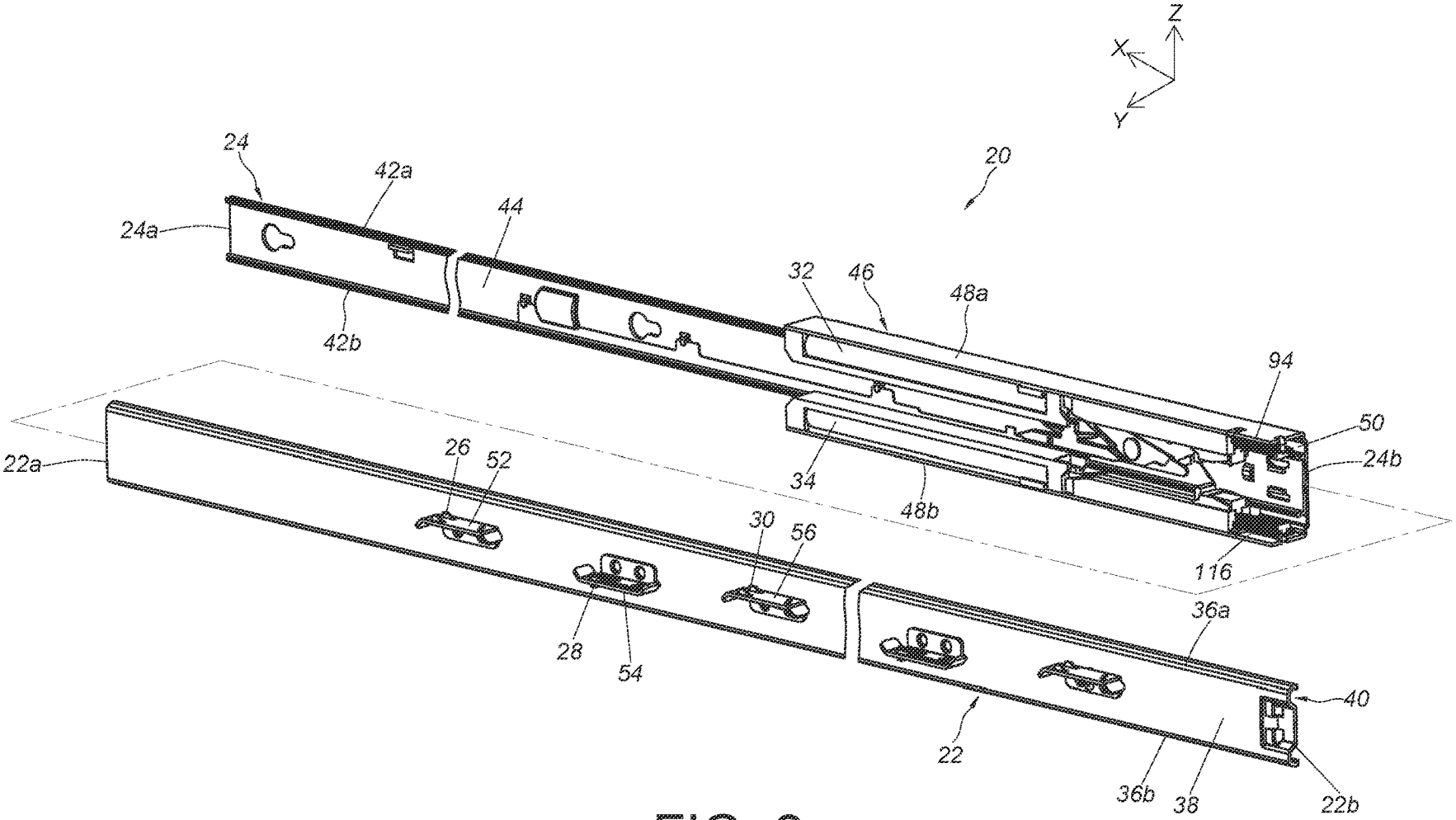
FIG. 2 is an exploded view of the slide rail assembly according to an embodiment of the present invention.

As shown in FIG. 1 and FIG. 2, a slide rail assembly 20 comprises a first rail 22 and a second rail 24 according to an embodiment of the present invention. The second rail 24 and the first rail 22 are longitudinally movable relative to each other, and the second rail 24 is configured to be located at a first predetermined position P2 (such as an extended position shown in FIG. 1) relative to the first rail 22. In the present embodiment, the X axis is a longitudinal direction (or a length direction) of the slide rail assembly 20, the Y axis is a transverse direction (or a lateral direction) of the slide rail assembly 20, and the Z axis is a vertical direction (or a height direction) of the slide rail assembly 20.

The slide rail assembly 20 further comprises a plurality of working members arranged on one of the first rail 22 and the second rail 24, and at least one damping module arranged on the other one of the first rail 22 and the second rail 24. In the present embodiment, the slide rail assembly 20 comprises two or more working members, such as a first working member 26, a second working member 28, and a third working member 30, sequentially arranged on the first rail 22 from front to back (please refer to FIG. 3 and FIG. 4). The damping module comprises one or more damping devices, such as a first damping device 32 and a second damping device 34, arranged on the second rail 24, but the present invention is not limited thereto.

Preferably, the first rail 22 comprises a first wall 36*a*, a second wall 36*b* and a longitudinal wall 38 connected between the first wall 36*a* and the second wall 36*b* of the first rail 22. A passage 40 (as shown in FIG. 2) is defined by the first wall 36*a*, the second wall 36*b* and the longitudinal wall 38 of the first rail 22, and configured to movably mount the second rail 24.

Preferably, the second rail 24 comprises a first wall 42*a*, a second wall 42*b* and a longitudinal wall 44 connected between the first wall 42*a* and the second wall 42*b* of the second rail 24. The first wall 42*a*, the second wall 42*b* and the longitudinal wall 44 of the second rail 24 correspond to the first wall 36*a*, the second wall 36*b* and the longitudinal wall 38 of the first rail 22 respectively.

Preferably, a base 46 is arranged on the second rail 24. The base 46 comprises a first supporting part 48*a*, a second supporting part 48*b* and a longitudinal part 50 connected between the first supporting part 48*a* and the second supporting part 48*b*. The base 46 is fixedly mounted to the second rail 24, such that the base 46 and the second rail 24 can be seen as one piece.

Preferably, the first supporting part 48*a* and the second supporting part 48*b* of the base 46 correspond to the first wall 36*a* and the second wall 36*b* of the first rail 22 for support.

Preferably, the first rail 22 has a front part 22*a* and a rear part 22*b*, and the second rail 24 has a front part 24*a* and a rear part 24*b*. The base 46 is arranged adjacent to the rear part 24*b* of the second rail 24. When the second rail 24 is located at the first predetermined position P1 relative to the first rail 22, the base 46 is configured to support at least a portion of the first rail 22 adjacent to the front part 22*a* of the first rail 22.

Figure 3:
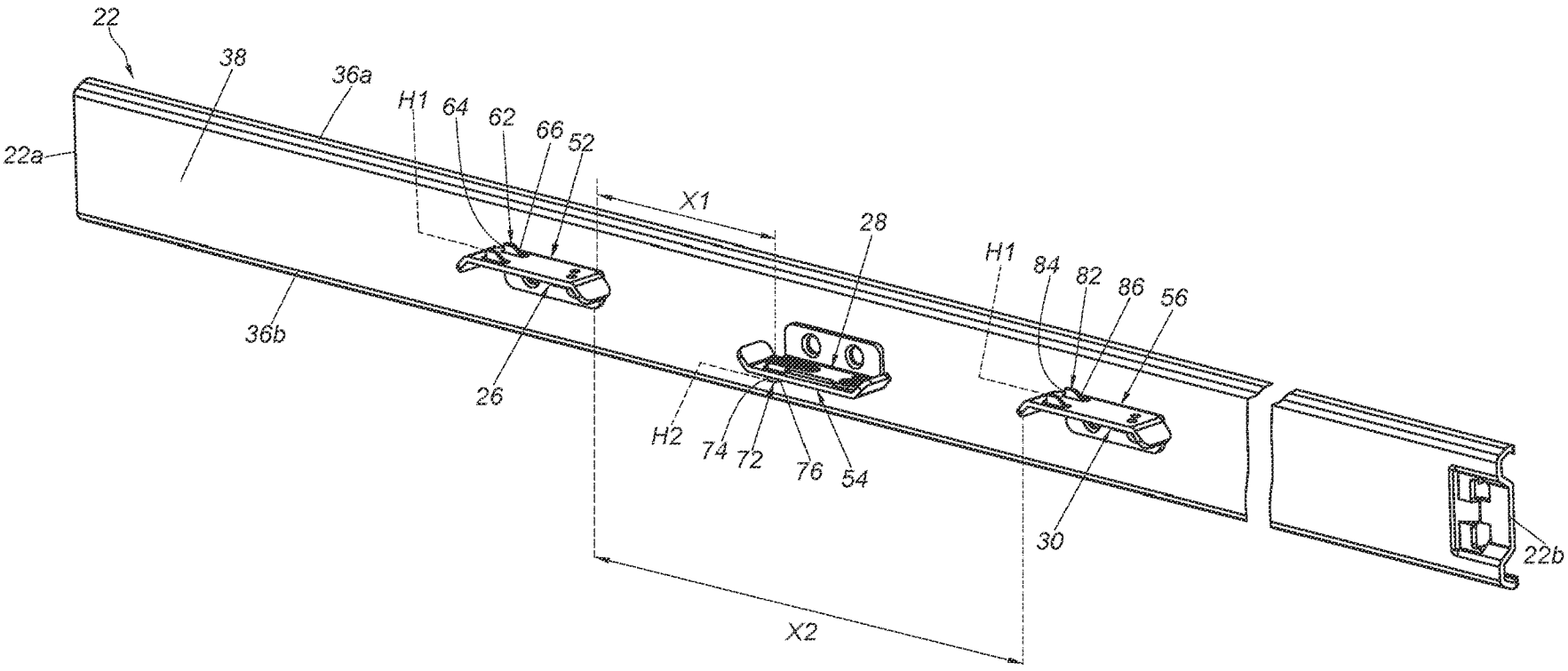
FIG. 3 is a diagram showing the first rail according to an embodiment of the present invention.
Figure 4:
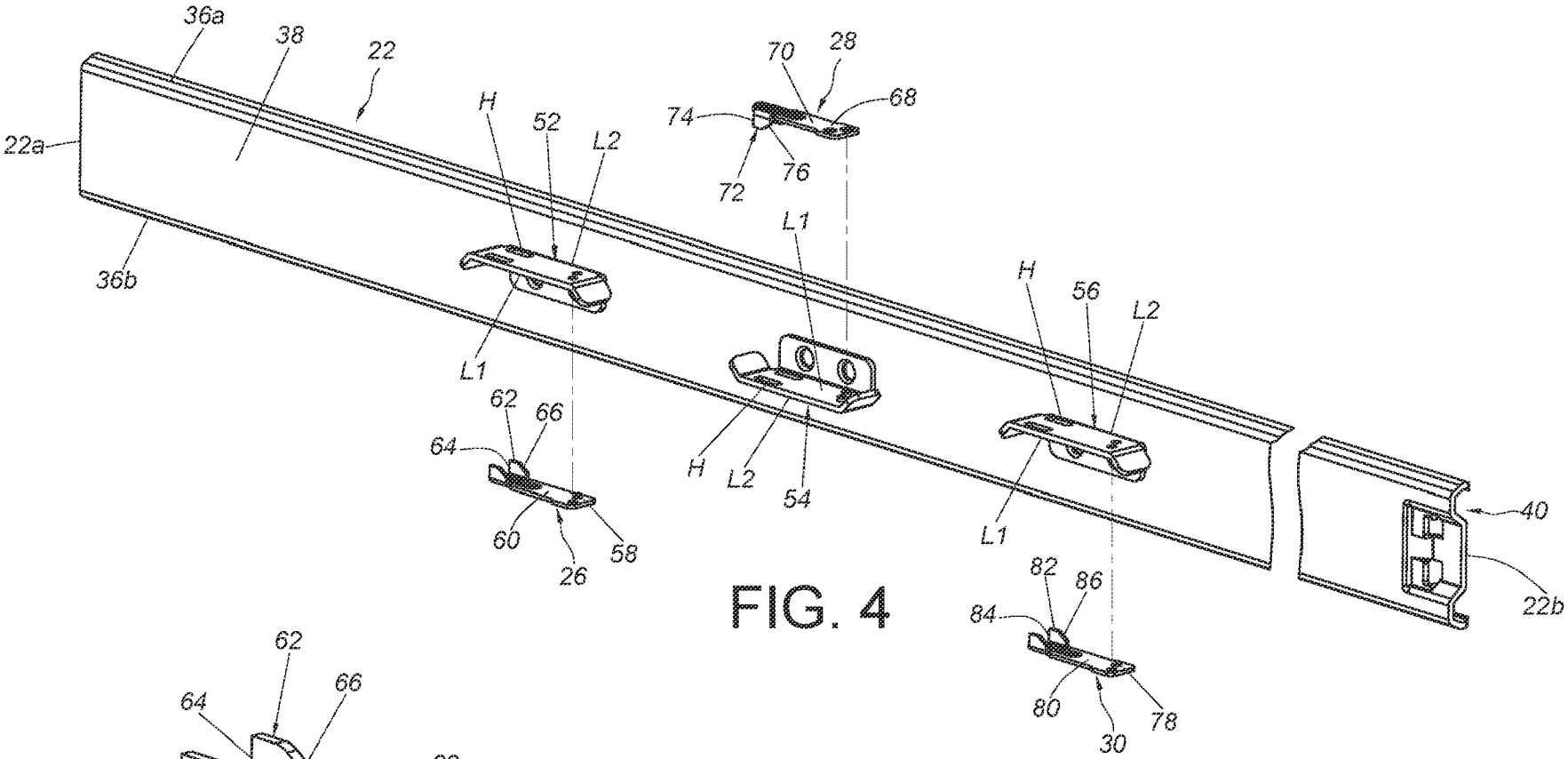
FIG. 4 is an exploded view of the first rail and a plurality of working members according to an embodiment of the present invention.

As shown in FIG. 3 and FIG. 4, the first working member 26, the second working member 28 and the third working member 30 are arranged along the length direction of the first rail 22, and are spaced from each other by a distance. The second working member 28 is located between the first working member 26 and the third working member 30.

Preferably, the first working member 26 and the second working member 28 are arranged at different vertical positions along the Z axis. Moreover, the first working member 26 and the third working member 30 are arranged at substantially a same first vertical position H1 along the Z axis, and the second working member 28 is arranged at a second vertical position H2 along the Z axis. The second vertical position H2 is different from the first vertical position H1 (as shown in FIG. 3).

Preferably, the first working member 26 and the second working member 28 are spaced from each other by a predetermined distance X1 along the X axis, and the first working member 26 and the third working member 30 are spaced from each other by a predetermined distance X2 greater than the predetermined distance X1 along the X axis (as shown in FIG. 3).

Preferably, the first working member 26, the second working member 28 and the third working member 30 have substantially identical structural configuration. In the present embodiment, the first working member 26, the second working member 28 and the third working member 30 are elastic pieces, but the present invention is not limited thereto.

Preferably, two or more than two mounting bases are arranged on the first rail 22. For example, a first mounting base 52, a second mounting base 54 and a third mounting base 56 are mounted (such as fixedly connected) to the first rail 22. The first mounting base 52, the second mounting base 54 and the third mounting base 56 are configured to mount the first working member 26, the second working member 28 and the third working member 30 respectively. Each of the first mounting base 52, the second mounting base 54 and the third mounting base 56 has a first side L1 and a second side L2 opposite to the first side L1, and at least one hole H communicating the first side L1 and the second side L2 (as shown in FIG. 4).

Figure 4A:
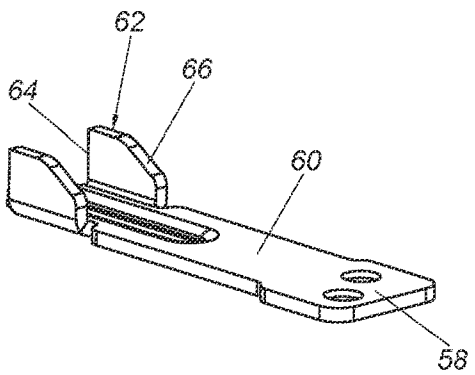
FIG. 4A is a diagram showing a working member according to an embodiment of the present invention.

Preferably, the first working member 26 comprises a first connecting part 58 and a first elastic part 60 extended from the first connecting part 58 (please refer to FIG. 4A). The first connecting part 58 of the first working member 26 is connected (such as fixedly connected) to the first side L1 of the first mounting base 52, and the first elastic part 60 of the first working member 26 has at least one first protrusion section 62. The at least one first protrusion section 62 is configured to pass through the at least one hole H from the first side L1 of the first mounting base 52 and protrude from the second side L2 of the first mounting base 52. A first blocking feature 64 and a first guiding structure 66 are respectively arranged at two opposite positions (such as front and rear positions) on the first protrusion section 62. For example, the first blocking feature 64 is a vertical wall, and the first guiding structure 66 has an inclined surface or an arc surface (please refer to FIG. 4A as well), but the present invention is not limited thereto.

Similarly, the second working member 28 comprises a second connecting part 68 and a second elastic part 70 extended from the second connecting part 68. The second connecting part 68 of the second working member 28 is connected (such as fixedly connected) to the first side L1 of the second mounting base 54, and the second elastic part 70 of the second working member 28 has at least one second protrusion section 72. The at least one second protrusion section 72 is configured to pass through the at least one hole H from the first side L1 of the second mounting base 54 and protrude from the second side L2 of the second mounting base 54. A second blocking feature 74 and a second guiding structure 76 are respectively arranged at two opposite positions (such as front and rear positions) on the second protrusion section 72. For example, the second blocking feature 74 is a vertical wall, and the second guiding structure 76 has an inclined surface or an arc surface, but the present invention is not limited thereto.

Similarly, the third working member 30 comprises a third connecting part 78 and a third elastic part 80 extended from the third connecting part 78. The third connecting part 78 of the third working member 30 is connected (such as fixedly connected) to the first side L1 of the third mounting base 56, and the third elastic part 80 of the third working member 30 has at least one third protrusion section 82. The at least one third protrusion section 82 is configured to pass through the at least one hole H from the first side L1 of the third mounting base 56 and protrude from the second side L2 of the third mounting base 56. A third blocking feature 84 and a third guiding structure 86 are respectively arranged at two opposite positions (such as front and rear positions) on the third protrusion section 82. For example, the third blocking feature 84 is a vertical wall, and the third guiding structure 86 has an inclined surface or an arc surface, but the present invention is not limited thereto.

Figure 5:
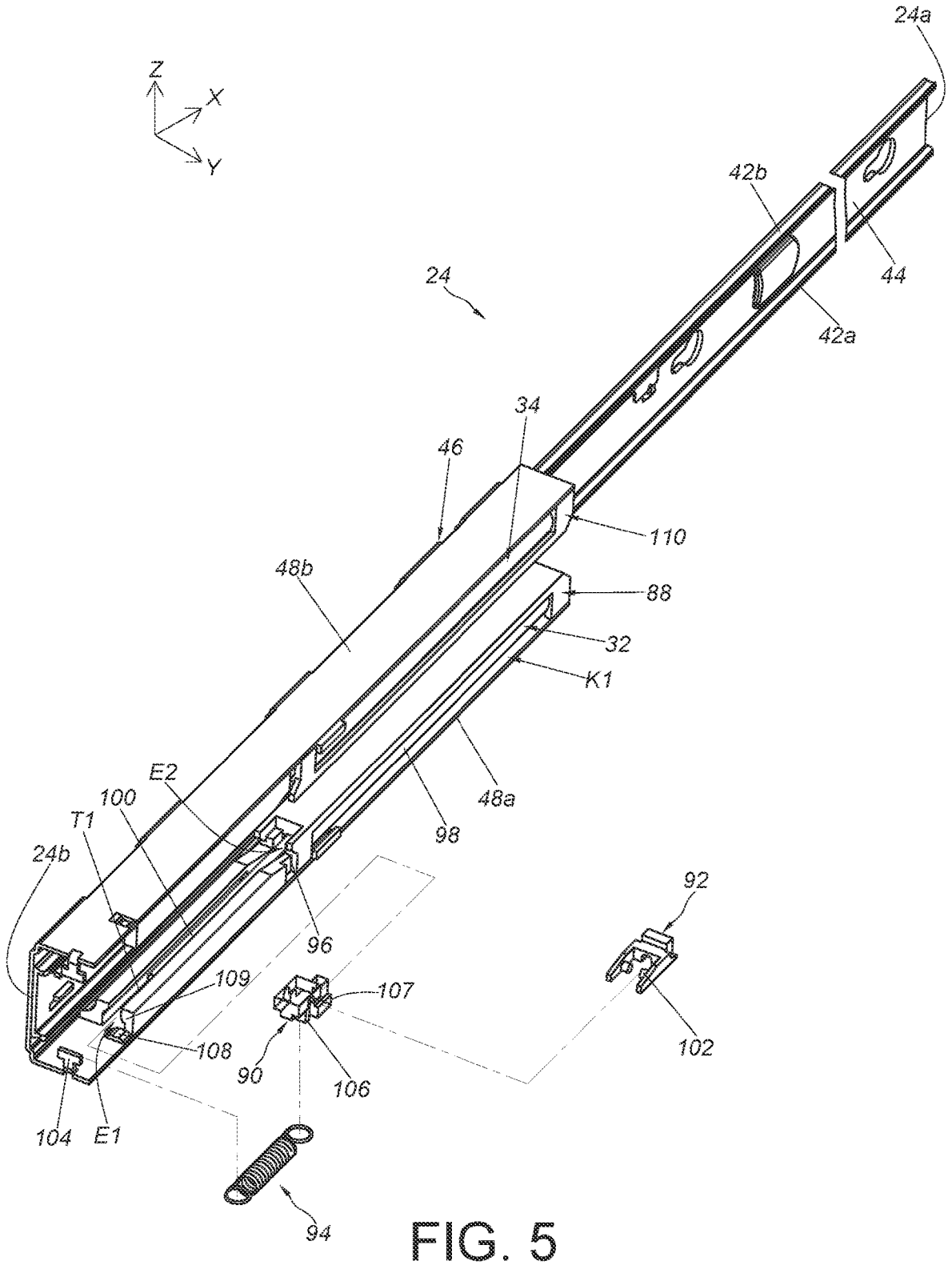
FIG. 5 is an exploded view of the second rail from a first viewing angle according to an embodiment of the present invention.

As shown in FIG. 5, one of the first damping device 32 and the second damping device 34 is adjacent to the first wall 42*a* of the second rail 24, and the other one of the first damping device 32 and the second damping device 34 is adjacent to the second wall 42*b* of the second rail 24. In the present embodiment, the first damping device 32 is adjacent to the first wall 42*a* of the second rail 24, and the second damping device 34 is adjacent to the second wall 42*b* of the second rail 24, but the present invention is not limited thereto.

Preferably, the slide rail assembly 20 further comprises a first supporting rack 88, a first slider 90, a first driving member 92 and a first elastic member 94.

The first supporting rack 88 is arranged on the second rail 24. In the present embodiment, the first supporting rack 88 is connected (such as fixedly connected) to the base 46 on the second rail 24, and the first supporting rack 88, the base 46 and the second rail 24 can be seen as one piece. The first supporting rack 88 is adjacent to the first supporting part 48*a* of the base 46. The first supporting rack 88 is mounted with the first damping device 32. The first supporting rack 88 is formed with a first path T1, and the first slider 90 is slidably movable along the first path T1. The first driving member 92 is movable relative to the second rail 24. In the present embodiment, the first driving member 92 is movably mounted to the first slider 90, and the second rail 24 comprises a first guiding feature 96 arranged on the first supporting rack 88. The first guiding feature 96 has an inclined surface (also shown in FIG. 7) or an arc surface, but the present invention is not limited thereto.

Preferably, the first supporting rack 88 is further formed with a first space K1, and the first damping device 32 comprises a first cylinder body 98 and a first rod body 100 retractable relative to each other. The first cylinder body 98 is mounted in the first space K1. A portion of the first rod body 100 is located on the first path T1. The first path T1 is arranged in the longitudinal direction. In other words, the first path T1 is arranged in a direction identical to the length direction of the second rail 24.

Preferably, the first driving member 92 is pivotally connected to the first slider 90 through a first shaft 102.

Preferably, the first elastic member 94 is connected to a first connecting part 104 of the base 46 and a first connecting feature 106 of the first slider 90.

Preferably, the first path T1 has a first end part E1 and a second end part E2 arranged at opposite positions. The first cylinder body 98 is adjacent to the second end part E2 of the first path T1, and the first rod body 100 is extended into the first path T1 from the second end part E2 of the first path T1.

Preferably, the base 46 comprises a first blocking part 108. The first blocking part 108 is configured to block the first slider 90 at the first end part E1 of the first path T1 for limiting the first slider 90.

Preferably, the first slider 90 comprises a pair of first wing parts 107 (due to the viewing angle, FIG. 5 only shows one of the first wing parts 107). The first wing parts 107 are configured to be supported by a pair of first matching features 109 on the first path T1 in order to prevent the first slider 90 from being detached from the first path T1 along the height direction of the second rail 24 (the Z-axis direction).

Figure 6:
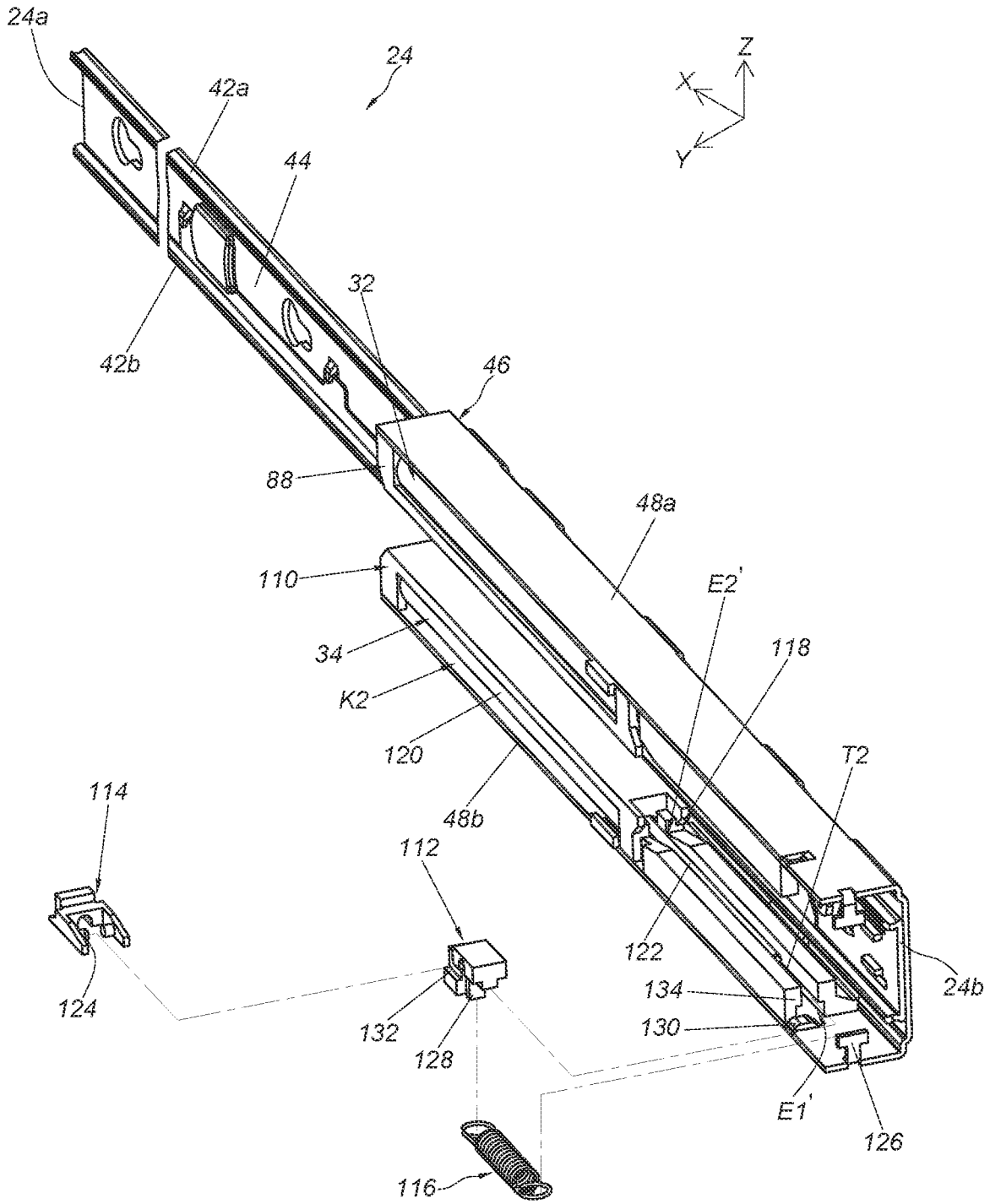
FIG. 6 is an exploded view of the second rail from a second viewing angle according to an embodiment of the present invention.

As shown in FIG. 6, FIG. 6 shows another viewing angle of FIG. 5 (for example, the first wall 42*a* and the second wall 42*b* of the second rail 24 in FIG. 6 are upside down as compared to FIG. 5). Preferably, the slide rail assembly 20 further comprises a second supporting rack 110, a second slider 112, a second driving member 114 and a second elastic member 116.

The second supporting rack 110 is arranged on the second rail 24. In the present embodiment, the second supporting rack 110 is connected (such as fixedly connected) to the base 46 on the second rail 24, and the second supporting rack 110, the base 46 and the second rail 24 can be seen as one piece. The second supporting rack 110 is adjacent to the second supporting part 48*b* of the base 46. The second supporting rack 110 is mounted with the second damping device 34. The second supporting rack 110 is formed with a second path T2, and the second slider 112 is slidably movable along the second path T2. The second driving member 114 is movable relative to the second rail 24. In the present embodiment, the second driving member 114 is movably mounted to the second slider 112, and the second rail 24 comprises a second guiding feature 118 arranged on the second supporting rack 110. The second guiding feature 118 has an inclined surface or an arc surface, but the present invention is not limited thereto.

Preferably, the second supporting rack 110 is further formed with a second space K2, and the second damping device 34 comprises a second cylinder body 120 and a second rod body 122 retractable relative to each other. The second cylinder body 120 is mounted in the second space K2. A portion of the second rod body 122 is located on the second path T2. The second path T2 is arranged in the longitudinal direction. In other words, the second path T2 is arranged in a direction identical to the length direction of the second rail 24.

Preferably, the second driving member 114 is pivotally connected to the second slider 112 through a second shaft 124.

Preferably, the second elastic member 116 is connected to a second connecting part 126 of the base 46 and a second connecting feature 128 of the second slider 112.

Preferably, the second path T2 has a first end part E1' and a second end part E2' arranged at opposite positions. The second cylinder body 120 is adjacent to the second end part E2' of the second path T2, and the second rod body 122 is extended into the second path T1 from the second end part E2' of the second path T2.

Preferably, the base 46 comprises a second blocking part 130. The second blocking part 130 is configured to block the second slider 112 at the first end part E1' of the second path T2 for limiting the second slider 112.

Preferably, the second slider 112 comprises a pair of second wing parts 132 (due to the viewing angle, FIG. 6 only shows one of the second wing parts 132). The second wing parts 132 are configured to be supported by a pair of second matching features 134 on the second path T2 in order to prevent the second slider 112 from being detached from the second path T2 along the height direction of the second rail 24 (the Z-axis direction).

Figure 7:
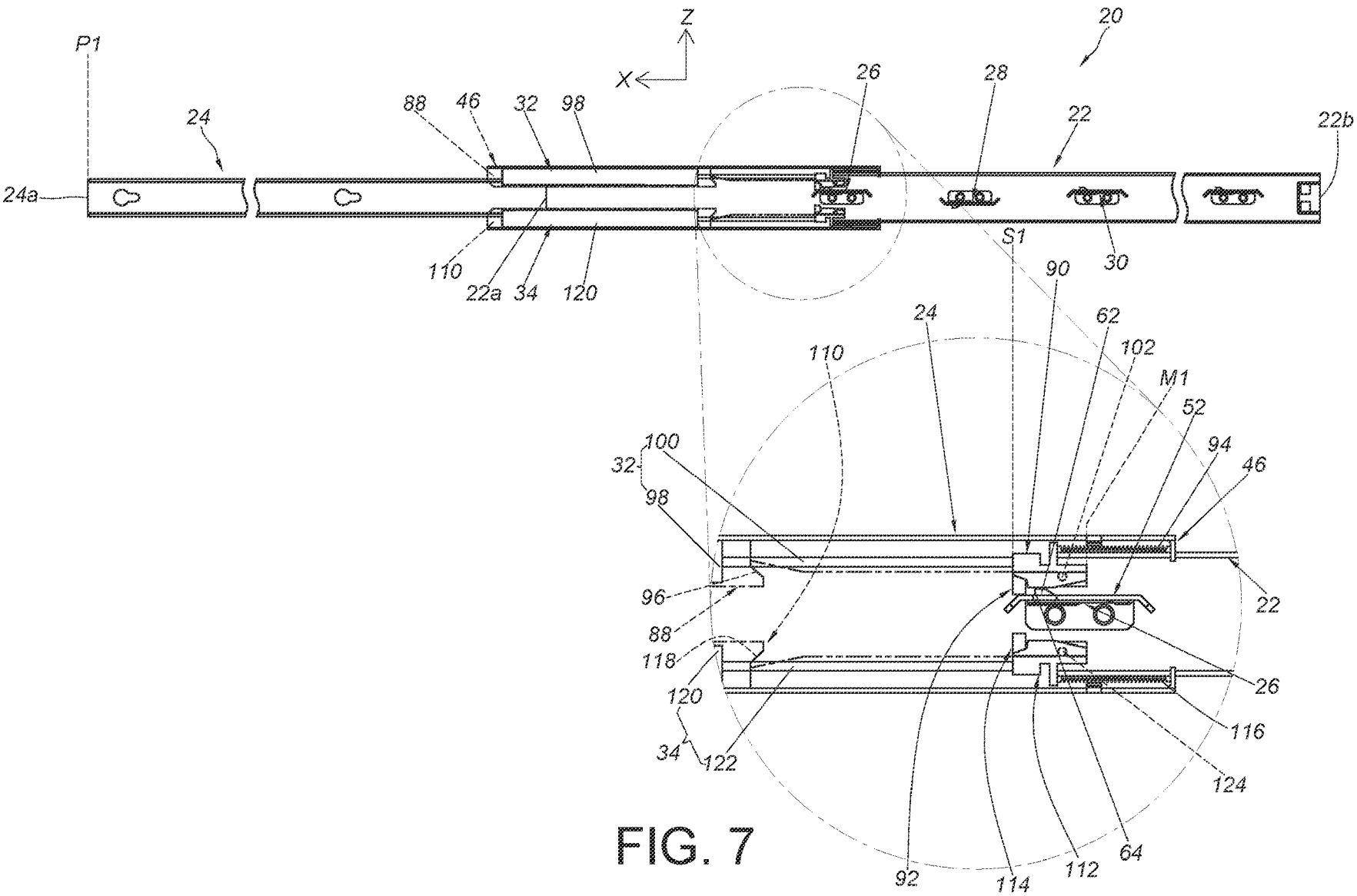
FIG. 7 is a diagram showing the second rail being located at the first predetermined position relative to the first rail according to an embodiment of the present invention.
Figure 8:
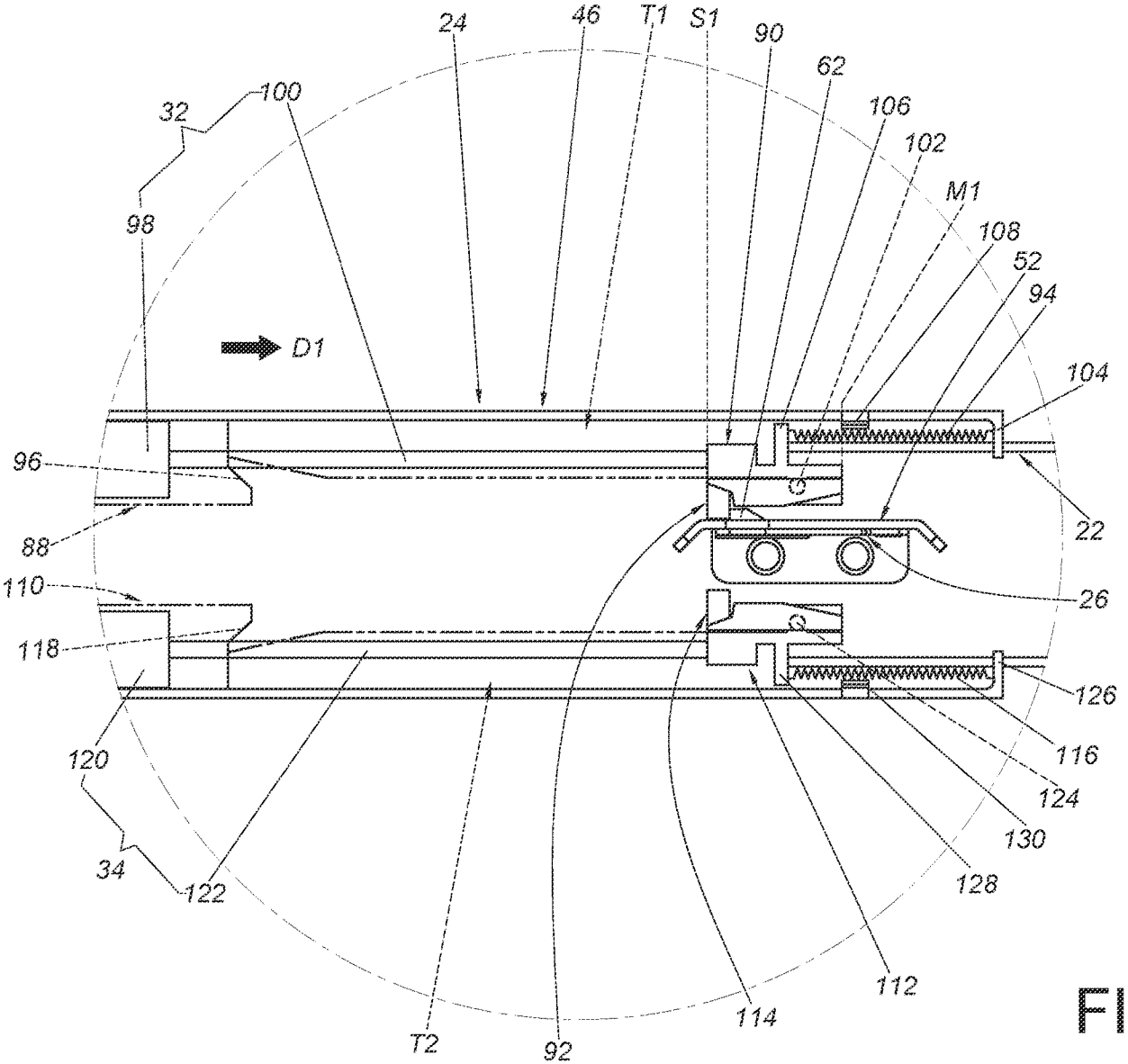
FIG. 8 is a diagram showing the second rail being moved relative to the first rail along a first direction according to an embodiment of the present invention.

As shown in FIG. 7 and FIG. 8, the first damping device 32 is in a first state S1 (such as an extended state or a damping preparation state). Moreover, the first cylinder body 98 of the first damping device 32 is internally arranged with a damping medium and/or an elastic member (such as a spring). Such configuration is well known to those skilled in the art, for simplification, no further illustration is provided.

Figure 9:
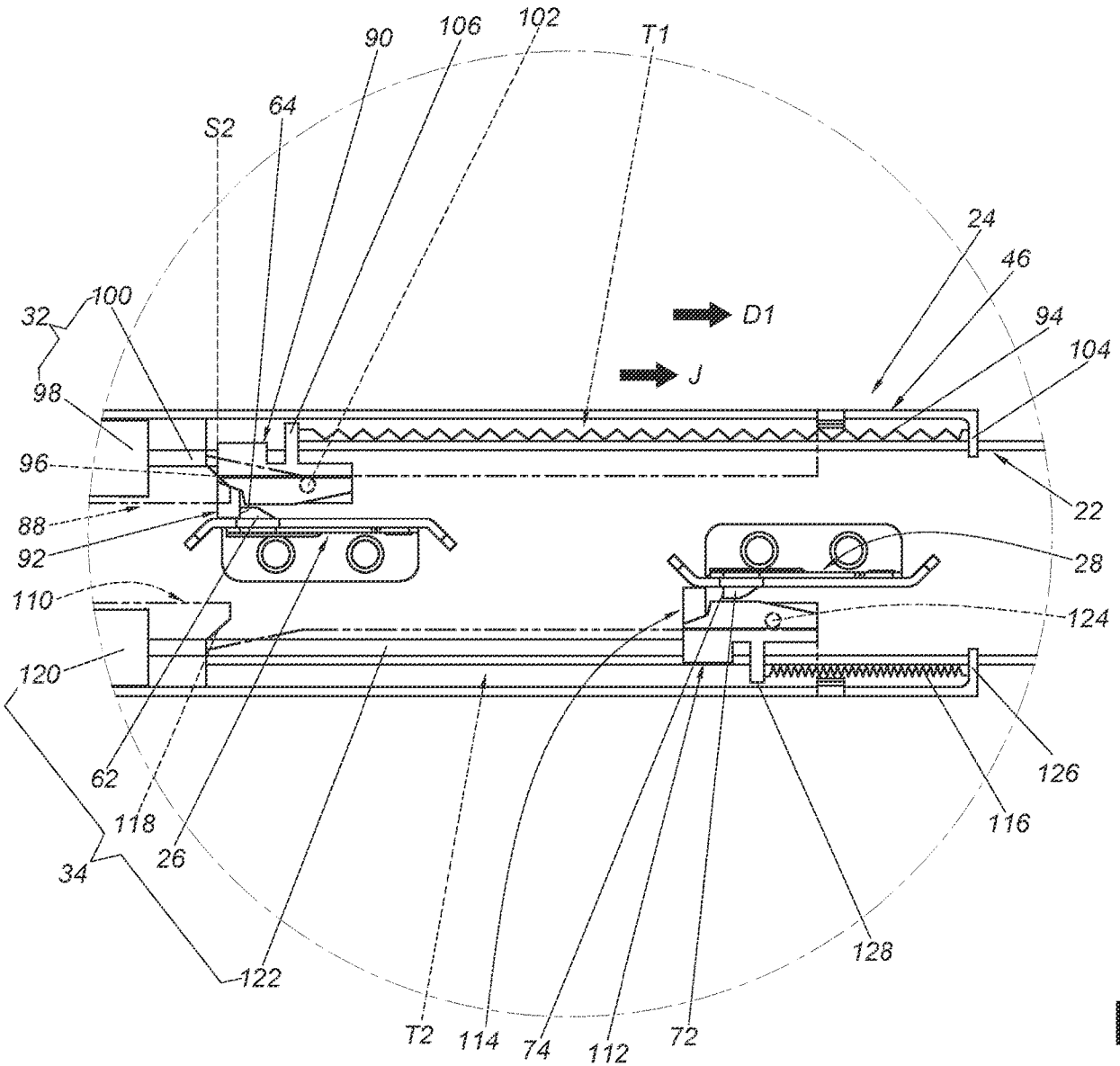
FIG. 9 is a diagram showing the second rail being further moved relative to the first rail along the first direction according to an embodiment of the present invention.

As shown in FIG. 7, FIG. 8 and FIG. 9, when the second rail 24 is moved relative to the first rail 22 from the first predetermined position P1 (as shown in FIG. 7) along a first direction D1, one of the two working members (one of the first working member 26 and the second working member 28, such as the first working member 26 in the present embodiment) is configured to interact with the first damping device 32 in order to provide damping effect (as shown in FIG. 9). The first direction D1 is a retracting direction, but the present invention is not limited thereto.

Preferably, when the second rail 24 is moved relative to the first rail 22 from the first predetermined position P1 along the first direction D1, the first working member 26 (the first blocking feature 64 of the first protrusion section 62 of the first working member 26) and the first driving member 92 contact each other to abut against each other (as shown in FIG. 8 and FIG. 9). As such, the first working member 26 is configured to interact with the first damping device 32 (as shown in FIG. 9) through driving the first driving member 92 (and the first slider 90) to move relative to the second rail 24 from a first initial position M1 (as shown in FIG. 8) along the first path T1 of the first supporting rack 88, so that the first rod body 100 of the first damping device 32 is moved relative to the first cylinder body 98 to switch the first damping device 32 from the first state S1 to a second state S2 (such as a retracted state as shown in FIG. 9) in order to provide damping effect. Meanwhile, the first elastic member 94 is in a state of accumulating an elastic force J.

Figure 10:
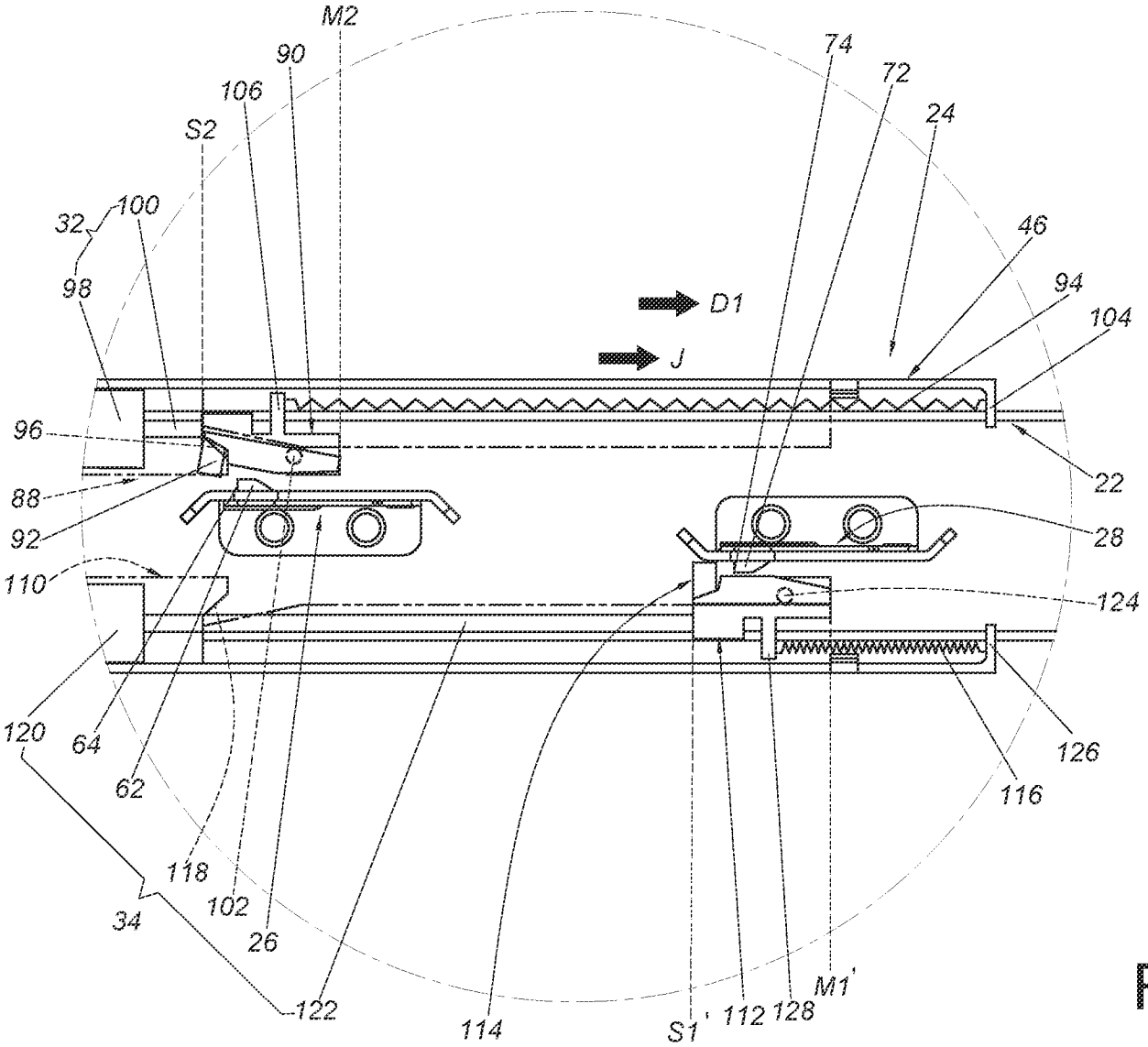
FIG. 10 is a diagram showing the second rail being further moved relative to the first rail along the first direction according to an embodiment of the present invention.
Figure 11:
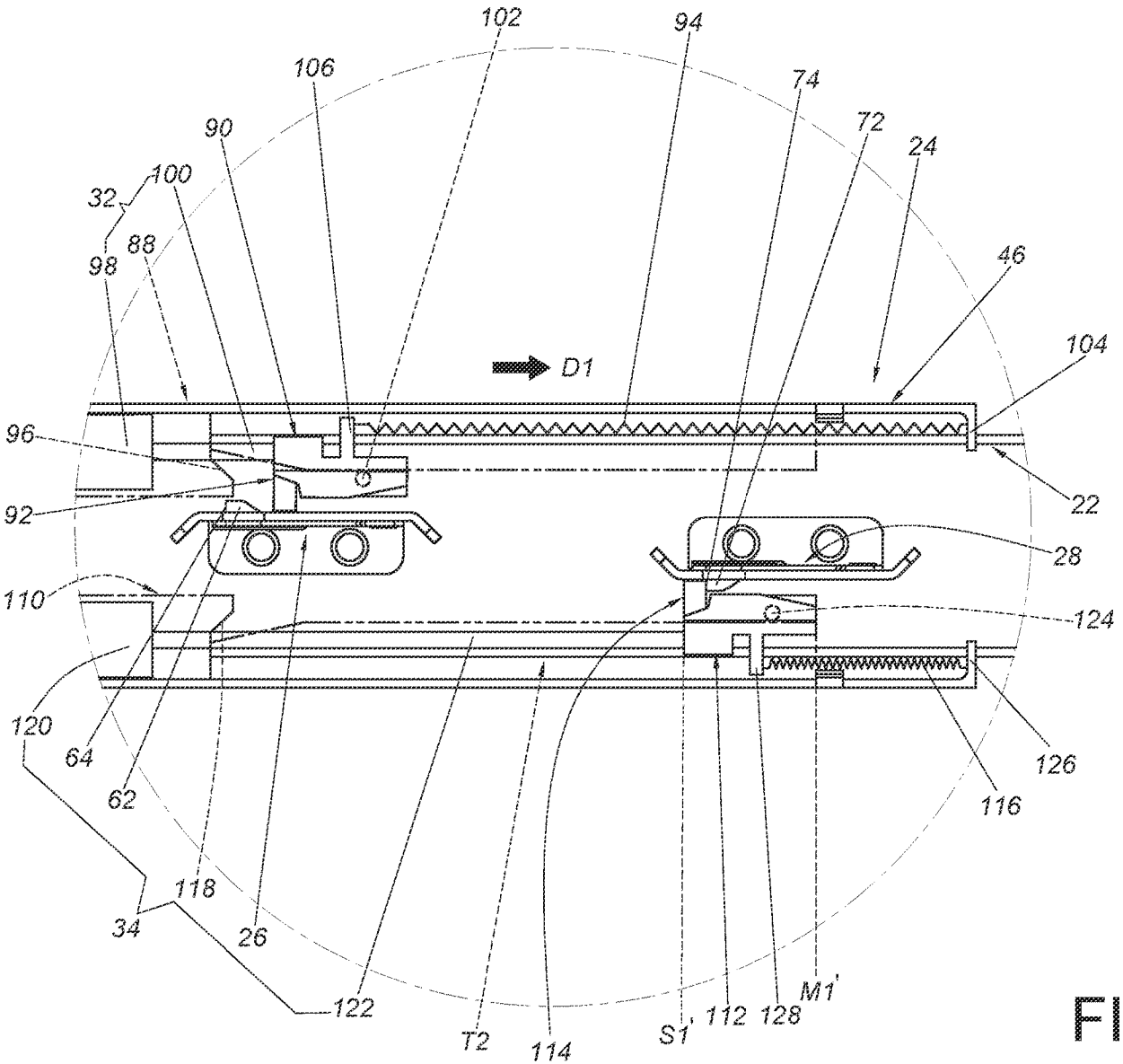
FIG. 11 is a diagram showing the second rail being further moved relative to the first rail along the first direction according to an embodiment of the present invention.
Figure 12:
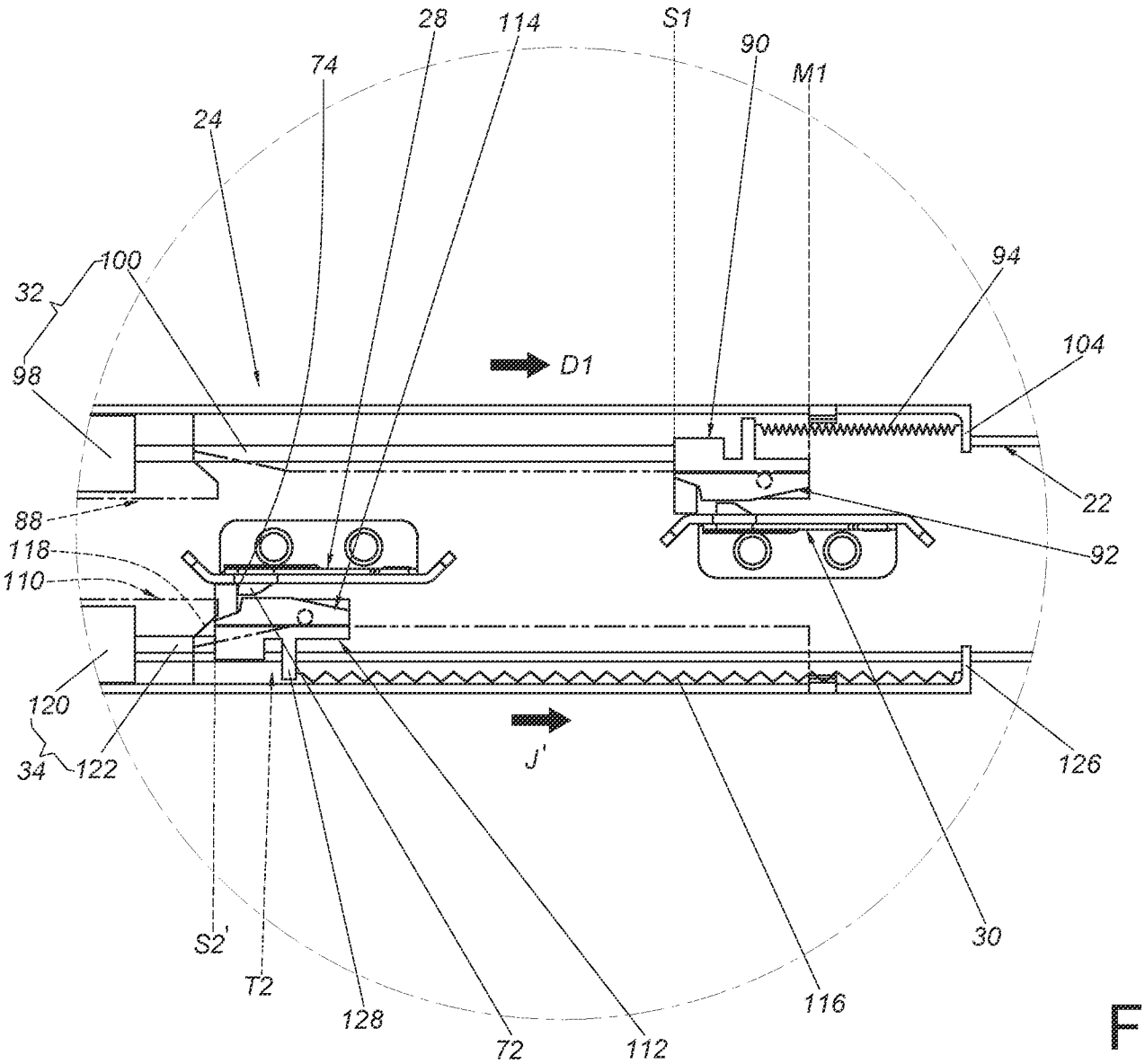
FIG. 12 is a diagram showing the second rail being further moved relative to the first rail along the first direction according to an embodiment of the present invention.

As shown in FIG. 10, FIG. 11 and FIG. 12, during a process of the second rail 24 being further moved relative to the first rail 22 along the first direction D1, the first guiding feature 96 is configured to guide the first driving member 92 to rotate to a first disengagement position M2 (as shown in FIG. 10), such that the first working member 26 (the first blocking feature 64 of the first protrusion section 62 of the first working member 26) and the first driving member 92 no longer contact each other in order to disable interaction between the first working member 26 and the first damping device 32 to stop providing damping effect. On the other hand, the first damping device 32 is configured to return to the first state S1 from the second state S2 through the damping medium and/or the elastic member in the first cylinder body 98 (as shown in FIG. 12). Such configuration is well known to those skilled in the art, for simplification, no further illustration is provided.

Preferably, during a process of the first damping device 32 returning to the first state S1 from the second state S2, the first damping device 32 is configured to drive the first driving member 92 to return to the first initial position M1 (as shown in FIG. 12) from the first disengagement position M2 (as shown in FIG. 10) through the first slider 90.

Preferably, the elastic force J of the first elastic member 94 (as shown in FIG. 10) is released to assist in accelerating the first driving member 92 returning to the first initial position M1 from the first disengagement position M2, and help the first damping device 32 to return to the first state S1 from the second state S2 more rapidly.

As shown in FIG. 10 and FIG. 11, the second damping device 34 and the first damping device 32 have substantially identical structural configuration. The second damping device 34 is in a first state S1' (such as an extended state or a damping preparation state).

As shown in FIG. 10, FIG. 11 and FIG. 12, when the second rail 24 is further moved relative to the first rail 22 along the first direction D1, the other one of the two working member (the other one of the first working member 26 and the second working member 28, such as the second working member 28 in the present embodiment) is configured to interact with the second damping device 34 in order to provide damping effect (as shown in FIG. 12).

Preferably, when the second rail 24 is further moved relative to the first rail 22 along the first direction D1, the second working member 28 (the second blocking feature 74 of the second protrusion section 72 of the second working member 28) and the second driving member 114 contact each other to abut against each other (as shown in FIG. 10 and FIG. 11). As such, the second working member 28 is configured to interact with the second damping device 34 (as shown in FIG. 12) through driving the second driving member 114 (and the second slider 112) to move relative to the second rail 24 from a second initial position M1' (as shown in FIG. 11) along the second path T2 of the second supporting rack 110, so that the second rod body 122 of the second damping device 34 is moved relative to the second cylinder body 120 to switch the second damping device 34 from the first state S1' to a second state S2' (such as a retracted state as shown in FIG. 12) in order to provide damping effect. Meanwhile, the second elastic member 116 is in a state of accumulating an elastic force J'.

Figure 13:
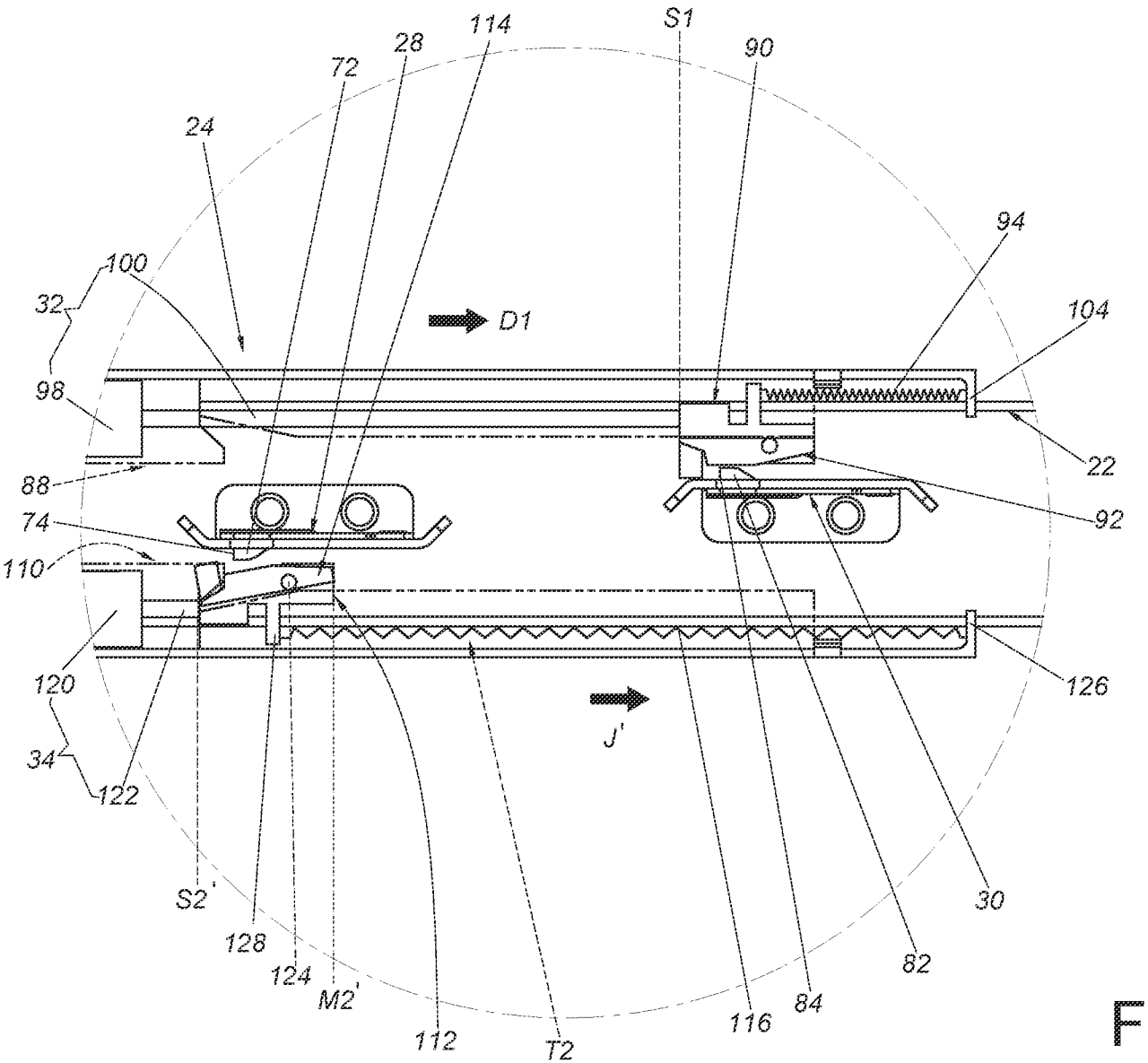
FIG. 13 is a diagram showing the second rail being further moved relative to the first rail along the first direction according to an embodiment of the present invention.
Figure 14:
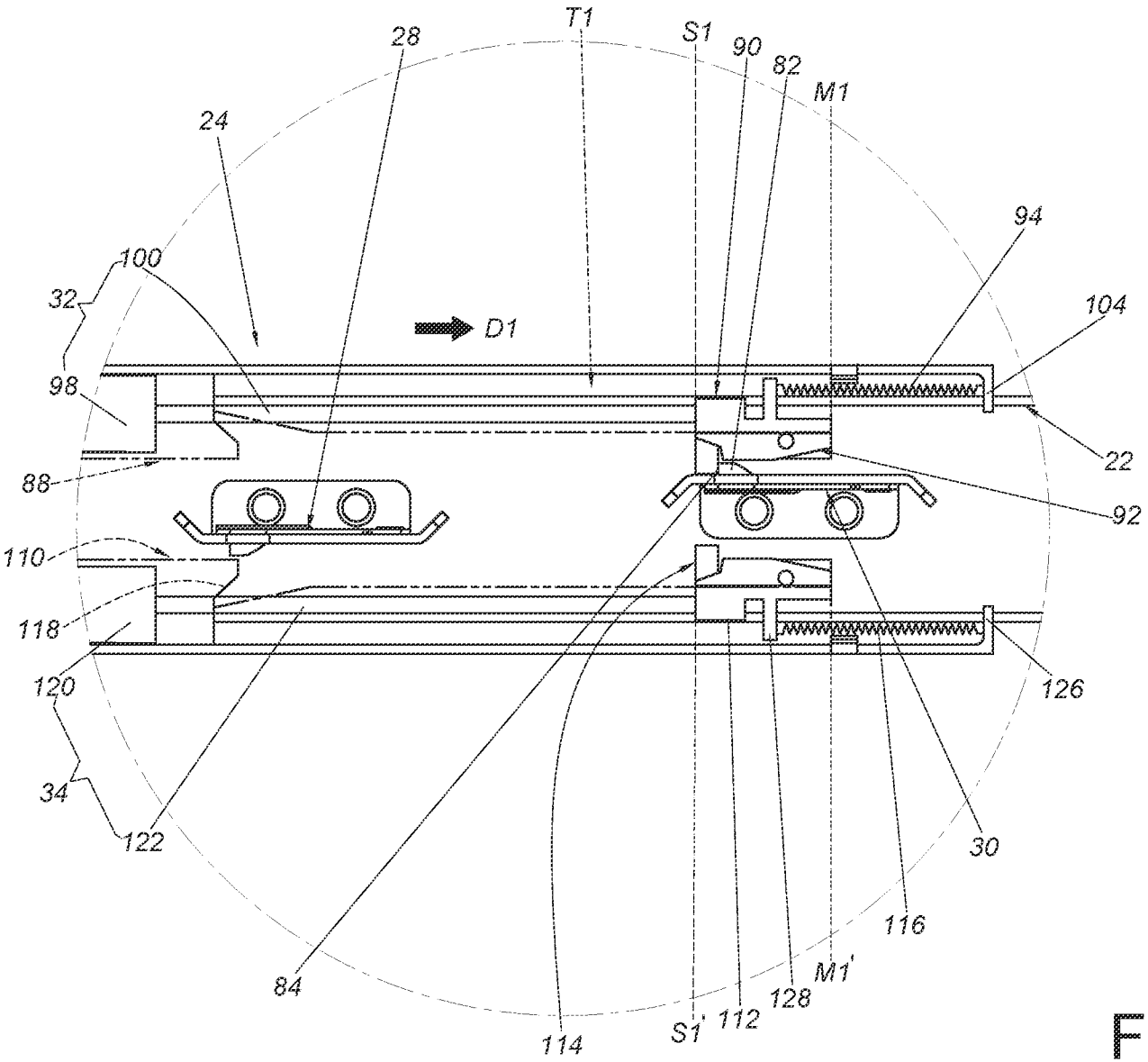
FIG. 14 is a diagram showing the second rail being further moved relative to the first rail along the first direction according to an embodiment of the present invention.

As shown in FIG. 13 and FIG. 14, during the process of the second rail 24 being further moved relative to the first rail 22 along the first direction D1, the second guiding feature 118 is configured to guide the second driving member 114 to rotate to a second disengagement position M2' (as shown in FIG. 13), such that the second working member 28 (the second blocking feature 74 of the second protrusion section 72 of the second working member 28) and the second driving member 114 no longer contact each other in order to disable interaction between the second working member 28 and the second damping device 34 to stop providing damping effect. On the other hand, the second damping device 34 is configured to return to the first state S1' from the second state S2' through the damping medium and/or the elastic member in the second cylinder body 120 (as shown in FIG. 14). Such configuration is well known to those skilled in the art, for simplification, no further illustration is provided.

Preferably, during a process of the second damping device 34 returning to the first state S1' from the second state S2', the second damping device 34 is configured to drive the second driving member 114 to return to the second initial position M1' (as shown in FIG. 14) from the second disengagement position M2' (as shown in FIG. 13) through the second slider 112.

Preferably, the elastic force J' of the second elastic member 116 (as shown in FIG. 13) is released to assist in accelerating the second driving member 114 returning to the second initial position M1' from the second disengagement position M2', and help the second damping device 34 to return to the first state S1' from the second state S2' more rapidly.

According to the aforementioned embodiment, the damping module comprises the first damping device 32 and the second damping device 34. The first working member 26 and the second working member 28 are configured to interact with the first damping device 32 and the second damping device 34 respectively in order to provide damping effect (at least two stages of damping effect) during the process of the second rail 24 being moved relative to the first rail 22 from the first predetermined position P1 along the first direction D1.

On the other hand, the damping module can comprise the first damping device 32 only. The first working member 26 and the third working member 30 are configured to interact with the first damping device 32, in order to provide damping effect (at least two stages of damping effect) during the process of the second rail 24 being moved relative to the first rail 22 from the first predetermined position P1 along the first direction D1.

Specifically, when the second rail 24 is moved relative to the first rail 22 from the first predetermined position P1 along the first direction D1, one of the two working member (one of the first working member 26 and the third working member 30, such as the first working member 26 in the present embodiment) is configured to interact with the first damping device 32 in order to provide damping effect. Such configuration is disclosed in FIG. 7, FIG. 8, FIG. 9 and the related aforementioned illustration, and no further illustration is provided.

As shown in FIG. 13 and FIG. 14, the first damping device 32 is in the first state S1 (such as an extended state or a damping preparation state). When the second rail 24 is further moved relative to the first rail 22 along the first direction D1, the other one of the two working members (the other one of the first working member 26 and the third working member 30, such as the third working member 30 in the present embodiment) is configured to interact with the first damping device 32 in order to provide damping effect.

Figure 15:
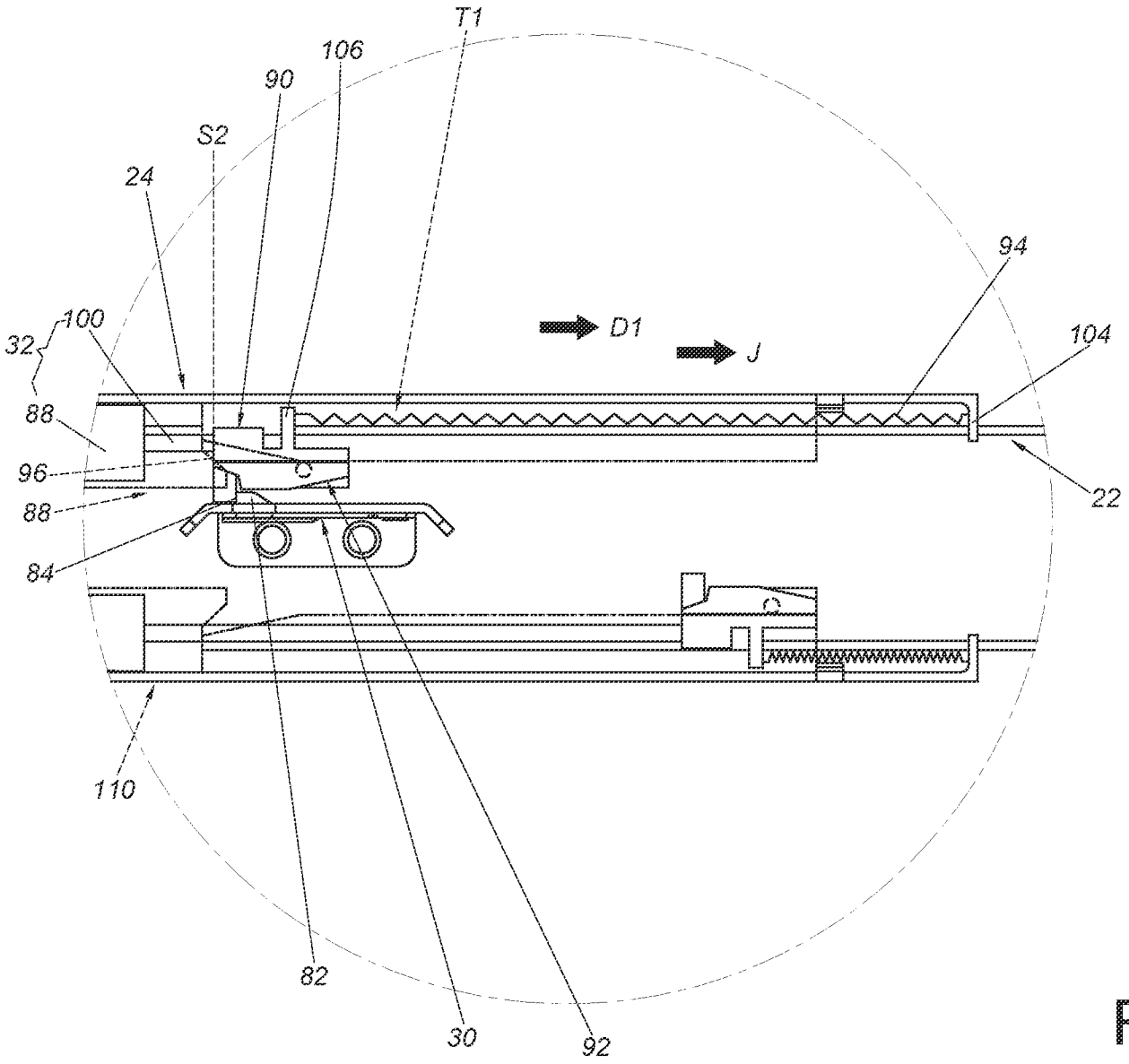
FIG. 15 is a diagram showing the second rail being further moved relative to the first rail along the first direction according to an embodiment of the present invention.

Preferably, as shown in FIG. 13, FIG. 14 and FIG. 15, when the second rail 24 is further moved relative to the first rail 22 along the first direction D1, the third working member 30 (the third blocking feature 84 of the third protrusion section 82 of the third working member 30) and the first driving member 92 contact each other to abut against each other (as shown in FIG. 14 and FIG. 15). As such, the third working member 30 is configured to interact with the first damping device 32 (as shown in FIG. 15) through driving the first driving member 92 (and the first slider 90) to move relative to the second rail 24 from the first initial position M1 (as shown in FIG. 14) along the first path T1 of the first supporting rack 88, so that the first rod body 100 of the first damping device 32 is moved relative to the first cylinder body 98 to switch the first damping device 32 from the first state S1 to the second state S2 (such as a retracted state as shown in FIG. 15) in order to provide damping effect. Meanwhile, the first elastic member 94 is in the state of accumulating the elastic force J.

Figure 16:
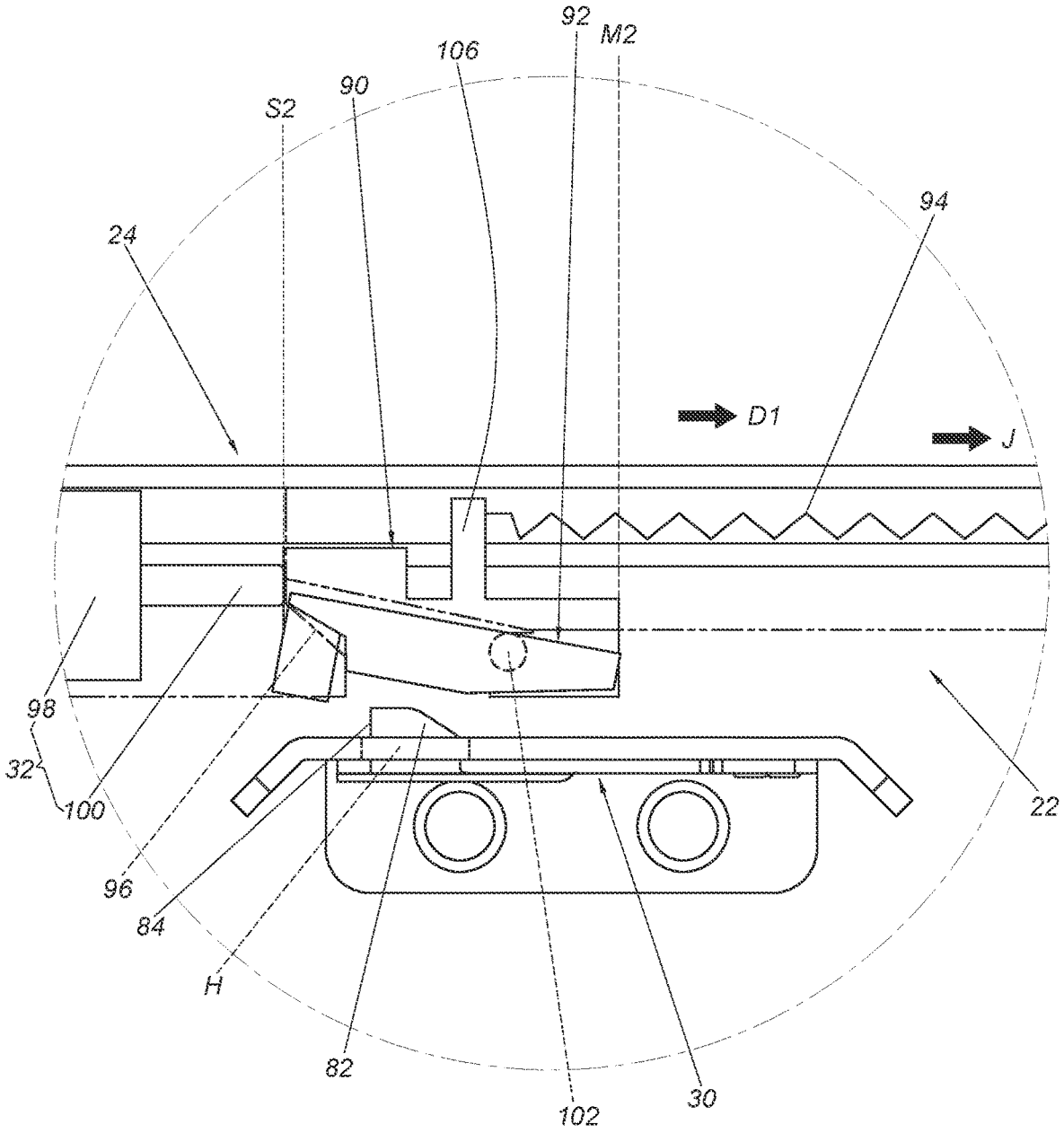
FIG. 16 is a diagram showing the second rail being further moved relative to the first rail along the first direction according to an embodiment of the present invention.
Figure 17:
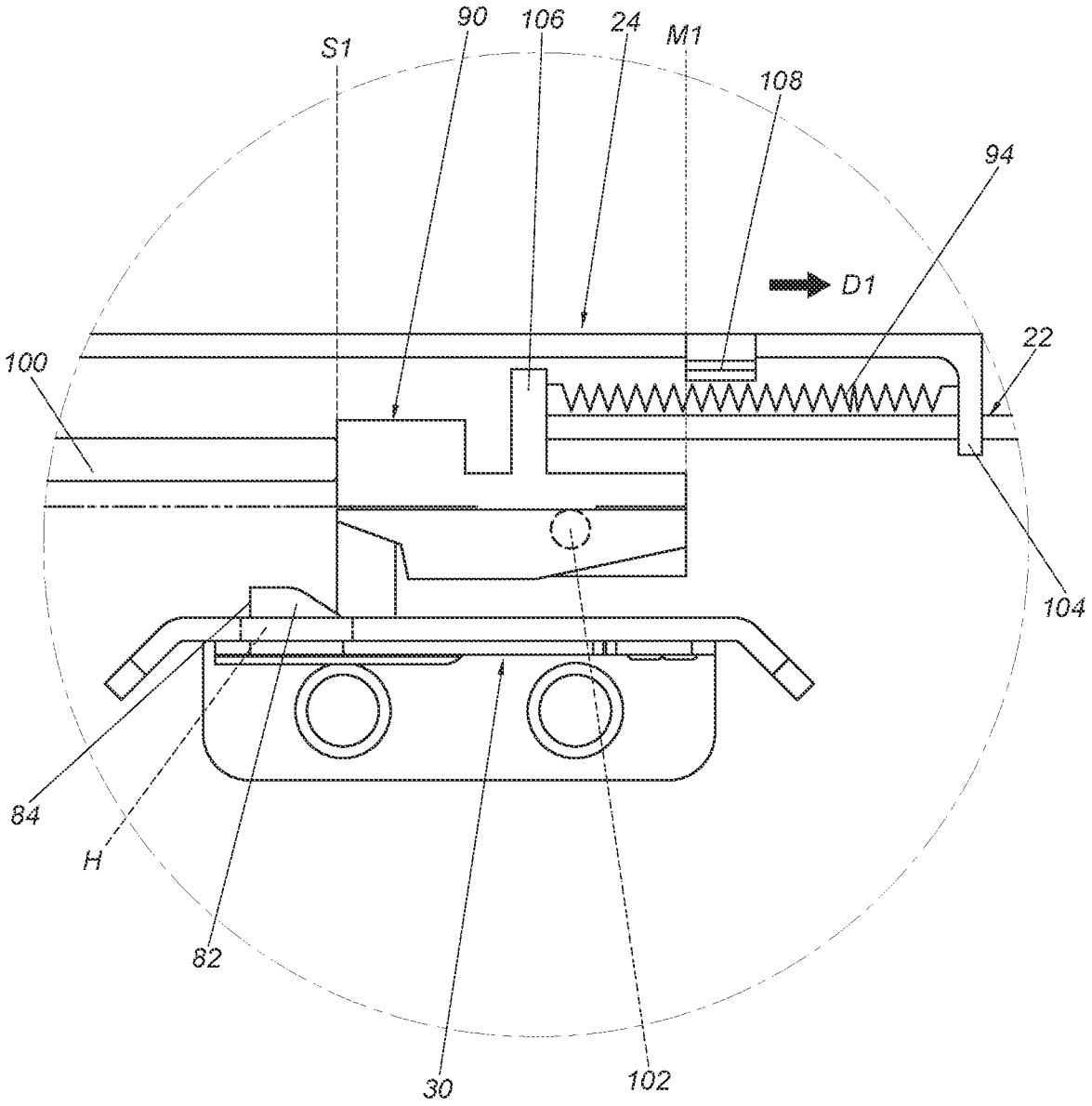
FIG. 17 is a diagram showing the second rail being further moved relative to the first rail along the first direction according to an embodiment of the present invention.

As shown in FIG. 16 and FIG. 17, during the process of the second rail 24 being further moved relative to the first rail 22 along the first direction D1, the first guiding feature 96 is configured to guide the first driving member 92 to rotate to the first disengagement position M2 (as shown in FIG. 16), such that the third working member 30 (the third blocking feature 84 of the third protrusion section 82 of the third working member 30) and the first driving member 92 no longer contact each other in order to disable interaction between the third working member 30 and the first damping device 32 to stop providing damping effect (as shown in FIG. 16). On the other hand, the first damping device 32 is configured to return to the first state S1 (as shown in FIG. 17) from the second state S2 (as shown in FIG. 16) through the damping medium and/or the elastic member in the first cylinder body 98. Such configuration is well known to those skilled in the art, for simplification, no further illustration is provided.

Preferably, during the process of the first damping device 32 returning to the first state S1 from the second state S2, the first damping device 32 is configured to drive the first driving member 92 to return to the first initial position M1 (as shown in FIG. 17) from the first disengagement position M2 (as shown in FIG. 16) through the first slider 90.

Preferably, the elastic force J of the first elastic member 94 (as shown in FIG. 16) is released to assist in accelerating the first driving member 92 returning to the first initial position M1 from the first disengagement position M2, and help the first damping device 32 to return to the first state S1 from the second state S2 more rapidly.

Figure 18:
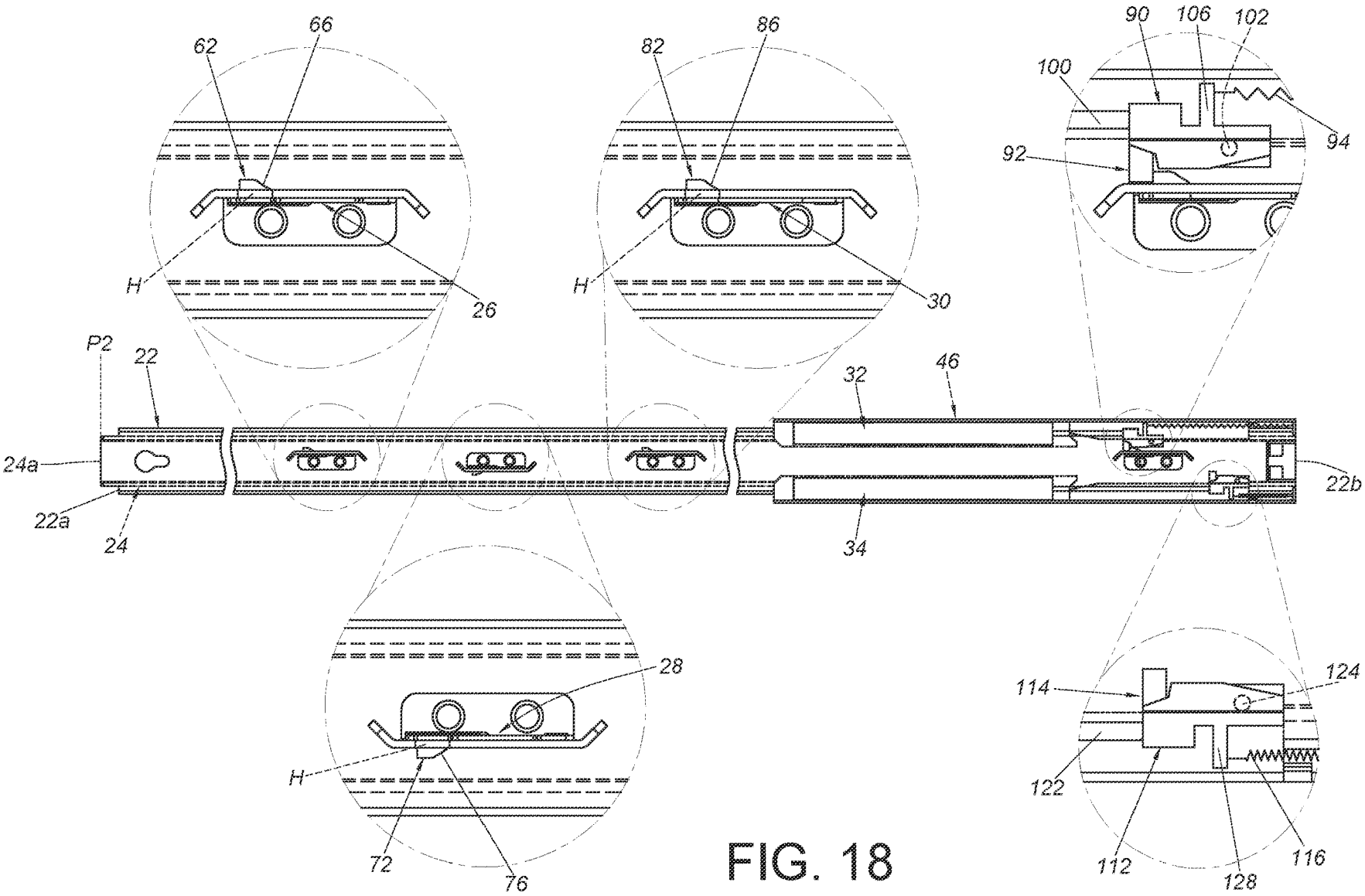
FIG. 18 is a diagram showing the second rail of the slide rail assembly being located at a second predetermined position relative to the first rail according to an embodiment of the present invention.

As shown in FIG. 18, the second rail 24 is located at a second predetermined position P2 (such as a retracted position) relative to the first rail 22. The base 46 is configured to support at least a portion of the first rail 22 adjacent to the rear part 22*b* of the first rail 22.

When the second rail 24 is moved relative to the first rail 22 from the second predetermined position P2 to the first predetermined position P1 along a second direction D2, the first damping device 32 and the second damping device 34 do not provide any damping effect.

For example, when the second rail 24 is located at the second predetermined position P2 relative to the first rail 22, the first driving member 92 corresponds to the first working member 26 (the first guiding structure 66 of the first protrusion section 62 of the first working member 26) and the third working member 30 (the third guiding structure 86 of the third protrusion section 82 of the third working member 30) which are arranged at the same vertical position, and the second driving member 114 corresponds to the second working member 28 (the second guiding structure 76 of the second protrusion section 72 of the second working member 28). Therefore, when the second rail 24 is moved relative to the first rail 22 from the second predetermined position P2 to the first predetermined position P1 along the second direction D2, the first driving member 92 is configured to cross the third working member 30 and the first working member 26 (that is, the first driving member 92 is configured to cross through the third guiding structure 86 of the third protrusion section 82 of the third working member 30 and the first guiding structure 66 of the first protrusion section 62 of the first working member 26 without generating any or sufficient interference), and the second driving member 114 is configured to cross the second working member 28 (that is, the second driving member 114 is configured to cross through the second guiding structure 76 of the second protrusion section 72 of the second working member 28 without generating any or sufficient interference), such that the first damping device 32 and the second damping device 34 do not provide damping effect. The second direction D2 is opposite to the first direction D1. For example, the second direction D2 is an opening direction.

Therefore, the slide rail assembly 20 according to the embodiments of the present invention has the following technical features: the first working member 26 and the second working member 28 are configured to interact with the first damping device 32 and the second damping device 34 respectively, and/or the first working member 26 and the third working member 30 are configured to interact with the first damping device 32, in order to provide two or more stages of damping effect during the process of the second rail 24 being moved relative to the first rail 22 from a predetermined position to another predetermined position along a direction. Therefore, the first rail 22 is arranged with a plurality of working members to interact with at least one damping device on the second rail 24, in order to provide damping effect in whole process of the second rail 24 being moved relative to the first rail 22 from the predetermined position to another predetermined position along the direction.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail;

a second rail longitudinally movable relative to the first rail;

a first working member and a second working member arranged on the first rail, the first and second working members being arranged at different vertical positions along a height direction of the slide rail assembly; and a damping module arranged on the second rail, wherein the damping module comprises a first damping device configured to interact with the first working member and a second damping device configured to interact with the second working member, the first and second working members are spaced from each other by a predetermined distance along a longitudinal direction of the slide rail assembly;

wherein when the second rail is moved relative to the first rail from a first predetermined position along a first direction, the first working member is configured to interact with the first damping device of the damping module in order to provide damping effect;

wherein when the second rail is further moved relative to the first rail along the first direction, the second working member is configured to interact with the second damping device of the damping module in order to provide damping effect.

2. The slide rail assembly of claim 1, further comprising a first driving member, wherein the second rail comprises a first guiding feature; wherein when the second rail is moved relative to the first rail from the first predetermined position along the first direction, the first working member is configured to interact with the first damping device through driving the first driving member to move relative to the second rail from a first initial position, such that the first damping device is switched from a first state to a second state in order to provide damping effect, and the first guiding feature is configured to guide the first driving member to a first disengagement position in order to disable interaction between the first working member and the first damping device.

3. The slide rail assembly of claim 2, further comprising a first elastic member; wherein the first driving member is configured to return to the first initial position from the first disengagement position in response to an elastic force of the first elastic member, to allow the first damping device to return to the first state from the second state.

4. The slide rail assembly of claim 2, further comprising a second driving member and a second elastic member, wherein the second rail further comprises a second guiding feature;

wherein when the second rail is further moved relative to the first rail along the first direction, the second working member is configured to interact with the second damping device through driving the second driving member to move relative to the second rail from a second initial position, such that the second damping device is switched from a first state to a second state in order to provide damping effect, and the second guiding feature is configured to guide the second driving member to a second disengagement position in order to disable interaction between the second working member and the second damping device; wherein the second driving member is configured to return to the second initial position from the second disengagement position in response to an elastic force of the second elastic member, to allow the second damping device to return to the first state from the second state.

5. The slide rail assembly of claim 4, further comprising a second supporting fame and a second slider; wherein the second supporting rack is arranged on the second rail, the second damping device is mounted on the second supporting rack, the second supporting rack is formed with a second path, and the second slider is slidably movable along the second path; wherein the second driving member is movably mounted to the second slider, and the second guiding feature is arranged on the second supporting rack.

6. The slide rail assembly of claim 5, wherein the second supporting rack is further formed with a second space, and the second damping device comprises a second cylinder body and a second rod body retractable relative to each other; wherein the second cylinder body is mounted in the second space, and a portion of the second rod body is located on the second path; wherein the second path is arranged along the longitudinal direction of the slide rail assembly.

7. The slide rail assembly of claim 2, further comprising a first supporting rack and a first slider; wherein the first supporting rack is arranged on the second rail, the first damping device is mounted on the first supporting rack, the first supporting rack is formed with a first path, and the first slider is slidably movable along the first path; wherein the first driving member is movably mounted to the first slider, and the first guiding feature is arranged on the first supporting rack.

8. The slide rail assembly of claim 7, wherein the first supporting rack is further formed with a first space, and the first damping device comprises a first cylinder body and a first rod body retractable relative to each other; wherein the first cylinder body is mounted in the first space, and a portion of the first rod body is located on the first path.

9. The slide rail assembly of claim 7, wherein the first path is arranged along the longitudinal direction of the slide rail assembly.

10. A slide rail assembly, comprising:

a first rail;

a second rail longitudinally movable relative to the first rail;

a plurality of working members arranged on the first rail, and a damping module arranged on the second rail;

wherein when the second rail is moved relative to the first rail from a first predetermined position along a first direction, a first one of the plurality of working members is configured to interact with the damping module in order to provide damping effect;

wherein when the second rail is further moved relative to the first rail along the first direction, a second one of the plurality of working members is configured to interact with the damping module in order to provide damping effect;

wherein the slide rail assembly further comprises a driving member, the second rail comprises a guiding feature, and the damping module comprises a damping device; wherein when the second rail is moved relative to the first rail from the first predetermined position along the first direction, the first one of the plurality of working members is configured to interact with the damping device through driving the driving member to move relative to the second rail from an initial position, such that the damping device is switched from a first state to a second state in order to provide damping effect, and the guiding feature is configured to guide the driving member to a disengagement position in order to disable interaction between the first one of the plurality of working members and the damping device.

11. The slide rail assembly of claim 10, wherein the plurality of working members are spaced from each other by a predetermined distance along a longitudinal direction of the slide rail assembly.

12. The slide rail assembly of claim 11, wherein the plurality of working members are arranged at substantially a same vertical position along a height direction of the slide rail assembly.

13. The slide rail assembly of claim 10, further comprising an elastic member, wherein the driving member is configured to return to the initial position from the disengagement position in response to an elastic force of the elastic member, to allow the damping device to return to the first state from the second state.

14. The slide rail assembly of claim 13, wherein when the second rail is further moved relative to the first rail along the first direction, the second one of the plurality of working members is configured interact with the damping device through driving the driving member to move relative to the second rail from the initial position, such that the damping device is switched from the first state to the second state in order to provide damping effect, and the guiding feature is configured to guide the driving member to the disengagement position in order to disable interaction between the second one of the plurality of working members and the damping device; wherein the driving member is configured to return to the initial position from the disengagement position in response to the elastic force of the elastic member, to allow the damping device to return to the first state from the second state.

15. The slide rail assembly of claim 14, further comprising a supporting rack and a slider; wherein the supporting rack is arranged on the second rail, the damping device is mounted on the supporting rack, the supporting rack is formed with a path, and the slider is slidably movable along the path; wherein the driving member is movably mounted to the slider, and the guiding feature is arranged on the supporting rack.

16. The slide rail assembly of claim 15, wherein the supporting rack is further formed with a space, and the damping device comprises a cylinder body and a rod body retractable relative to each other; wherein the cylinder body is mounted in the space, and a portion of the rod body is located on the path.

17. The slide rail assembly of claim 15, wherein the path is arranged along a longitudinal direction of the slide rail assembly.

18. The slide rail assembly of claim 10, wherein the damping device does not provide damping effect when the second rail is moved relative to the first rail from a second predetermined position along a second direction to the first predetermined position; wherein the second direction is opposite to the first direction.

* * * * *